US006742766B2

(12) United States Patent
Nowell et al.

(10) Patent No.: US 6,742,766 B2
(45) Date of Patent: Jun. 1, 2004

(54) DUAL ASSIST HYDROPNEUMATIC JACK

(76) Inventors: Kevin W. Nowell, 4314 Stella Ct., Arlington, TX (US) 76017; Leo J. Waldinger, 208 E. Allen, Godley, TX (US) 76044

( * ) Notice: Subject to any disclaimer, the term of this patent is extended or adjusted under 35 U.S.C. 154(b) by 177 days.

(21) Appl. No.: 10/022,927

(22) Filed: Dec. 17, 2001

(65) Prior Publication Data

US 2002/0084448 A1 Jul. 4, 2002

Related U.S. Application Data

(60) Provisional application No. 60/255,798, filed on Dec. 15, 2000.

(51) Int. Cl.[7] ..... B66F 7/16

(52) U.S. Cl. ..... 254/89 H; 254/93 H; 254/93 R

(58) Field of Search ..... 254/89 H, 93 H, 254/1, 8 R, 2 B, 93 R, 93 VA

(56) References Cited

U.S. PATENT DOCUMENTS 3,627,268 A * 12/1971 Wills ..... 254/423
4,215,851 A * 8/1980 Holmen ..... 254/277
4,472,183 A * 9/1984 Mace ..... 55/378
4,746,097 A * 5/1988 Chung et al. ..... 254/93 H
5,103,937 A * 4/1992 Robertson ..... 187/414

* cited by examiner

*Primary Examiner*—Lee D. Wilson
(74) *Attorney, Agent, or Firm*—Jenkens & Gilchrist, P.C.

(57) ABSTRACT

A dual-assist hydropneumatic jack. The dual-assist hydropneumatic jack includes a frame having an upper portion, a lower portion, and a central portion. The central portion defines a chamber therein. A plurality of cylinders are coupled to the frame. A plurality of wheel assemblies are provided coupled to respective ends of the frame, and are adapted to support the jack during loading and unloading. A hydraulic assembly provides hydraulic fluid to and receives hydraulic fluid from the plurality of cylinders. A flow divider is provided between the hydraulic assembly and the plurality of cylinders to divide hydraulic fluid between the respective cylinders. The cylinder includes mechanism for raising and lowering in response to hydraulic fluid being introduced therein and evacuated therefrom. The cylinder is assisted in lowering by the introduction of air into the cylinder and by the weight of the load.

26 Claims, 5 Drawing Sheets

DUAL ASSIST HYDROPNEUMATIC JACK

RELATED APPLICATION

This application claims the benefit of U.S. Provisional Application Ser. No. 60/255,798 filed Dec. 15, 2000.

TECHNICAL FIELD

The present invention generally relates to a hydropneumatic jack, and more specifically, a method and apparatus for supporting automobiles and other loads which has dual hydropneumatic capabilities via air assist and hydraulic assist methods, and is adjustable for supporting loads of varying widths.

BACKGROUND OF THE INVENTION

The use of jacks to raise loads, including lift systems, is known in the prior art. More specifically, lift systems heretofore devised and utilized are known to consist basically of familiar, expected and obvious structural configurations, notwithstanding the myriad of designs encompassed by the crowded prior art which have been developed for the fulfilment of countless objectives and requirements.

These jacks may comprise scissor-like lifters, which take up excessive space. This is exacerbated given that users of these lifters may need to access parts of the load, such as vehicles and the like, at precise locations that maybe blocked or otherwise vertically and horizontally inhibit access to these locations.

The most commonly available jacking system currently used today are mechanical jacking devices that require the user to place the jack under the object to be lifted, such as one side or end of a motor vehicle, and mechanically operate the jack to extend the lifting axis and raise the object. Mechanical jacking devices have a number of commonly known disadvantages, including lack of stability and strength and the requirement of mechanical effort on part of the user. Another disadvantage of mechanical lifting devices is the amount of space required for the user to effectively utilize the mechanical jack. The space requirement limits the usefulness of these devices in situations where there is not much room for the user to operate the mechanical jack.

Pneumatic jacks overcome many of the limitations of mechanical jacking devices and are commonly used to lift various objects in many different situations. A number of such jacks are portable to allow use at locations other than at fixed facilities, such as repair workshops or garages. Once placed under the portion of the vehicle the user desires to raise, air or hydraulic fluid is directed toward the jack to extend it and raise the vehicle. In general, pneumatic jacks are suitable for lifting relatively heavy objects without requiring an undue amount of space or effort on part of the jack user.

A number of low profile pneumatic jacks are known. The known pneumatic jacks generally utilize a telescopically extendable lifting axis that extends in response to the introduction of air or hydraulic fluid into the jack. These type of jacks have a number of disadvantages, including known problems with the telescopic member sticking or even jamming during lifting or lowering operations.

While the raising and lowering of the jack maybe controlled by air or hydraulic fluid, there remains efficiency concerns with respect to the speed of raising and lowering the device. Such prior devices are limited in this regard by either the flow of hydraulic fluid or the air flow. There also remains supply problems to the raising members, such that multiple pumps are required depending on the number of raising members in the jack.

SUMMARY OF THE INVENTION

To overcome the problems of inadequate access spacing, cumbersome equipment, and multiple pumps per raising member, the principles of the present invention provide for an apparatus and method for an adjustable hydropneumatic jack that has a dual system for raising and lowering a load, such as a motor vehicle in the like.

The dual-assist hydropneumatic jack of the present invention includes a frame having an upper portion, a lower portion, and a central portion. The central portion defines a chamber therein. A plurality of cylinders are coupled to the frame. A plurality of wheel assemblies are provided coupled to respective ends of the frame, and are adapted to support the jack during loading and unloading. A hydraulic assembly provides hydraulic fluid to and receives hydraulic fluid from the plurality of cylinders. A flow divider is provided between the hydraulic assembly and the plurality of cylinders to divide hydraulic fluid between the respective cylinders. The cylinder includes a means for raising and lowering in response to hydraulic fluid being introduced therein and evacuated therefrom. The cylinder is assisted in lowering by the introduction of air into the cylinder and by the weight of the load.

In operation, first a dual-assist hydropneumatic jack is provided having a plurality of cylinders having a fluid portion and an air portion. The jack is next located under a load. Lift pads or adapters with lift pads may be placed on the plurality of cylinders. The jack is then raised by providing hydraulic fluid from a hydraulic assembly through a flow divider to a respective fluid portion in a respective one of said plurality of cylinders. To lower the jack, the hydraulic fluid is removed from the fluid portion and air is provided to a respective air portion in said respective one of said plurality of cylinders.

In this fashion, valuable access space is saved due to the compact size of the jack. Further, unnecessary pumps are eliminated through the use of a flow divider. Finally, the use of air and the weight of the load provides an efficient and faster means of lowering the jack.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION

Current jacks, including certain pneumatic jacks, are very costly, space-consuming and slow during operation. There has not been available any apparatus which minimizes space consumption, reduces costs through the elimination of here to fore integral parts, and speeds up operation of the jack.

The present invention provides a solution to these dilemmas. Several adjustably movable cylinders are provided herein which are fluidly coupled to a hydraulic assembly. The hydraulic assembly assists in the provision of both air and hydraulic fluid to the adjustably movable cylinders and control the raising and lowering of the cylinders thereby. In addition, the present invention, through its structure, may provide a smaller profile, and therefore accord a user more space when using the present invention. Through the elimination of at least one pump from the assembly of the present invention, the overall cost of the assembly is significantly reduced. In addition, the dual-feed of both air and hydraulic fluid into independent portions of the cylinders allows the cylinders to be raised and lowered more quickly and efficiently.

Figure 1:
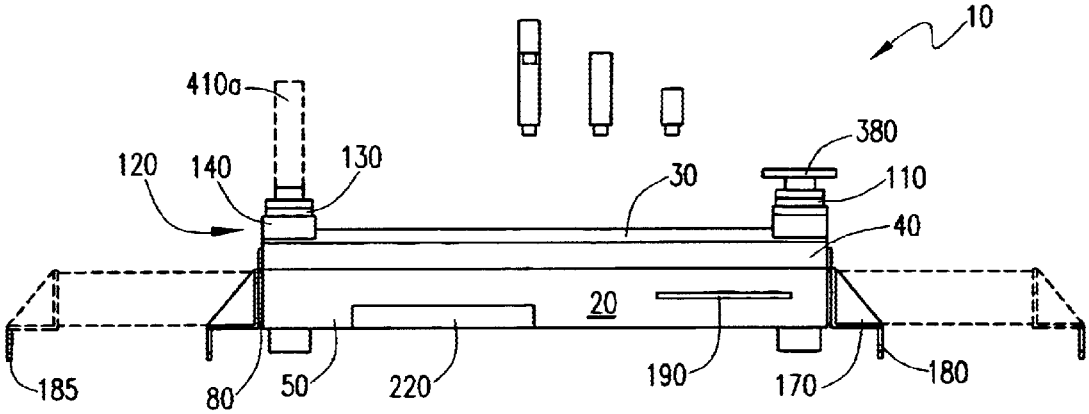
FIG. 1 is an exemplary side view of the dual assist hydropneumatic jack according to the principles of the present invention.
Figure 2:
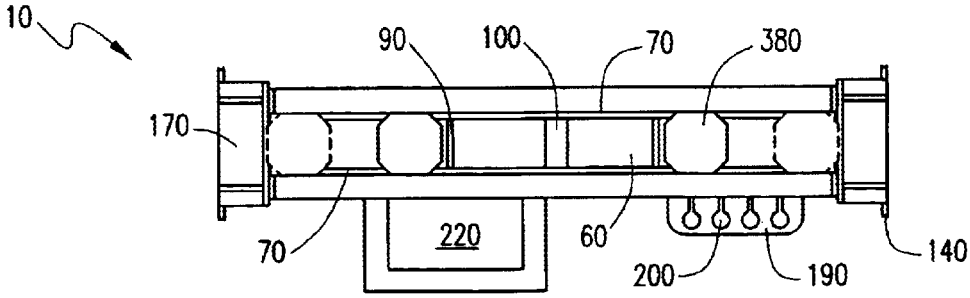
FIG. 2 is an exemplary top perspective view of the dual assist hydropneumatic jack of FIG. 1, with the supporting posts in two exemplary positions.
Figure 3:
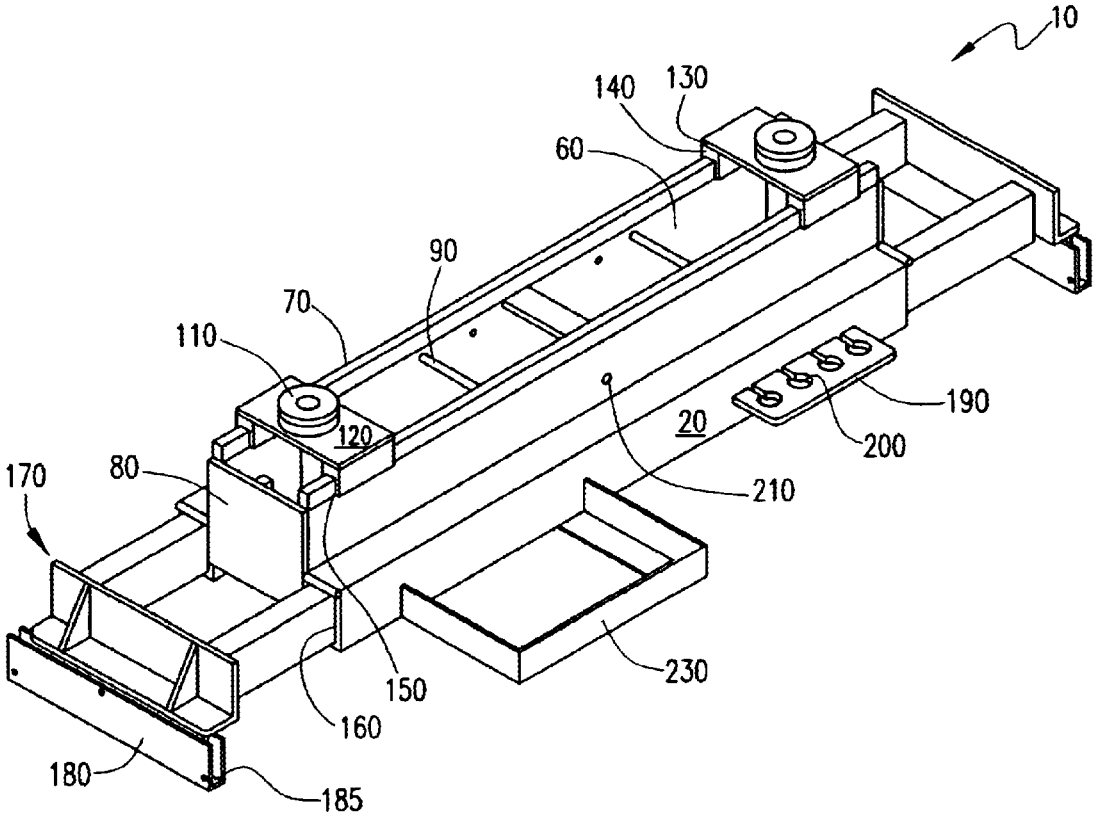
FIG. 3 is an exemplary isometric perspective of the dual assist hydropneumatic jack of FIG. 1.

Referring now to the drawings, and more particular to FIGS. 1–3 incombination, there is shown an exemplary side view of a dual assist hydropneumatic jack 10. The jack 10 includes a substantially rectangular frame 20 having an upper portion 30, a central portion 40, and a lower portion 50. The frame 20 maybe composed of metallic materials and the like. The perimeter walls of the frame 20 forms a chamber 60. A plurality of slide bars 70 are provided on the upper portion 30 of the frame 20, and span the width of the frame 20. In preferred embodiments, the plurality of slide bars 70 are parallel. Best seen in FIG. 3, a plurality of end caps 80 are provided on the respective ends of the frame 20.

Still referring to FIGS. 1–3 in combination, a plurality of stops 90 separate walls of the frame 20 and add structural stability thereto. Best seen in FIGS. 2 and 3, a frame support 100 is centrally coupled in the chamber 60. At least one cylinder 110 is coupled to the plurality of slide bars 70 via guide assembly 120. The guide assembly 120 is adapted to slidably move from one end of the frame 20 on the plurality of slide bars 70. Accordingly, it is preferred that the guide assembly 120 be composed of a suitable material, such as a thermoplastic, to minimize frictional resistance to sliding against the slide bars 70. The guide assembly 120 is composed of an upper plate 130 and side plates 140. The upper plate 130 is adapted to receive the cylinder 110 therethrough. The side plates 140 have grooves 150 formed thereon to slidably engage the slide bars 70.

Figure 4:
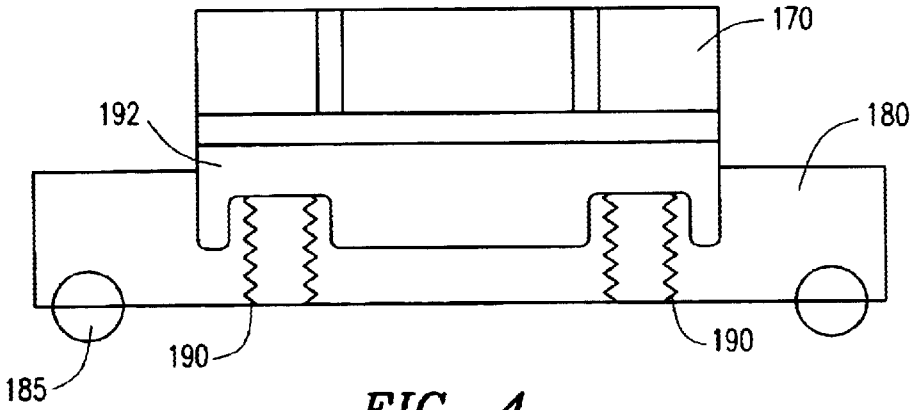
FIG. 4 is an exemplary perspective view of a wheel assembly for the dual assist hydropneumatic jack of FIG. 1.

Referring now to FIGS. 1–4 in combination, slidably coupled to the frame 20 via slide channels 160 is an axle assembly 170. The axle assembly 170 is adjustable through the slide channels 160, and may be moved towards or away from the jack 10, depending on the requirements of the system. This is indicated in FIG. 1 by the dashed lines showing the axle assembly 170 in a first and second configuration. The axle assembly 170 includes a wheel assembly 180. As best seen in FIG. 4, the wheel assembly 180 houses a plurality of wheels 185 which allow the jack 10 to be moved and positioned. The wheel assembly 180 further includes a plurality of biased resilient members 190, such as a spring, coupled to a base support 192, such that when the jack 10 is unloaded, the wheels allow the jack 10 to be moved. When the jack 10 is under a predetermined load, the biased resilient members 190 compress and allow the base support 192 to contact the ground.

In certain embodiments, an adapter holder 188 is coupled to the lower portion 50 of the frame 20. The adapter holder has adapter portions 200 for conveniently locating adapters and the like. The central portion 40 of the frame 20 may also have a hydraulic/air connection orifice 210 adapted to receive air and hydraulic lines therethrough as best seen in FIG. 3.

Figure 5:
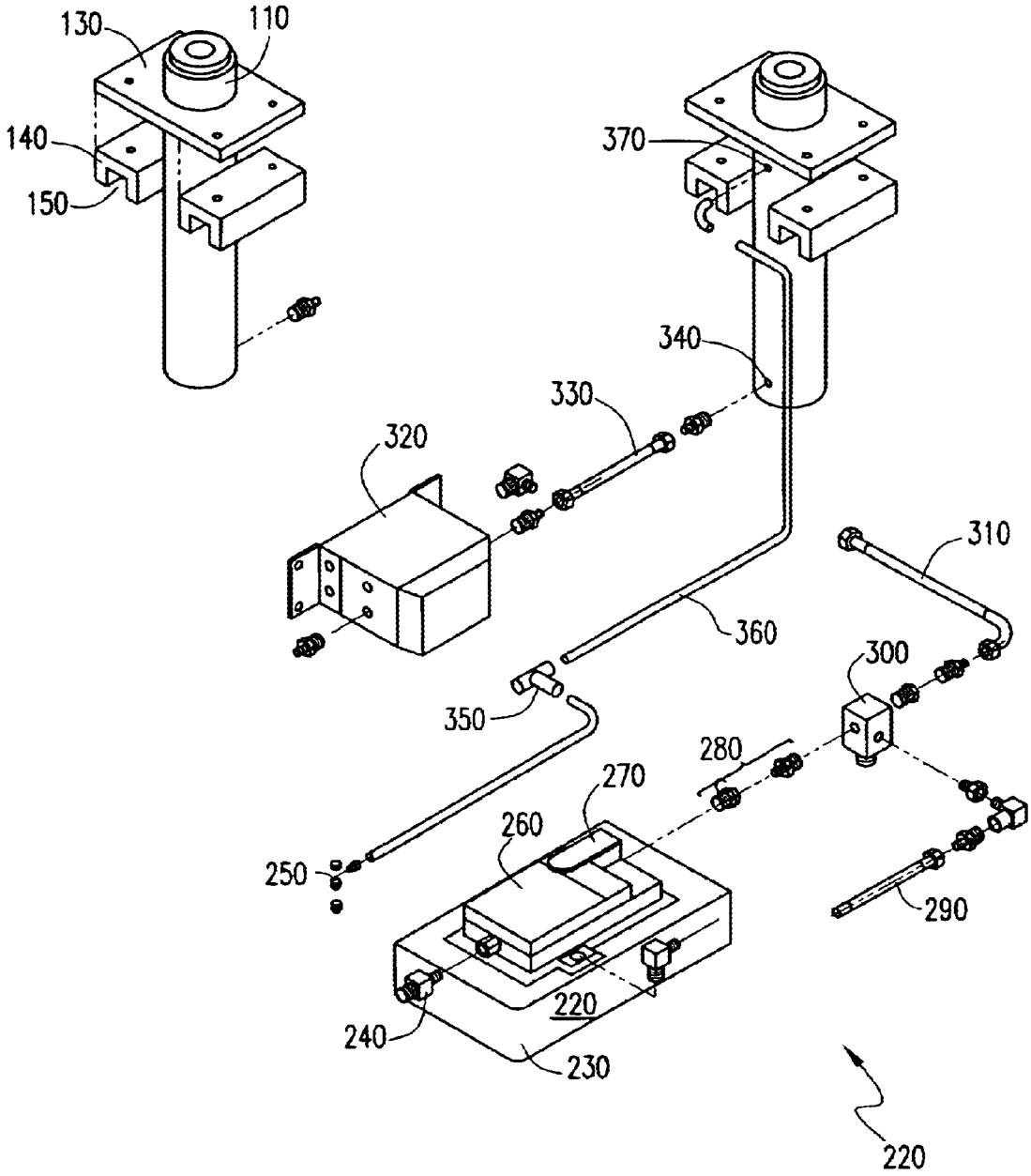
FIG. 5 is an exemplary exploded perspective view of the hydraulics assembly for the dual assist hydropneumatic jack of FIG. 1.

Referring now to FIG. 5, there is shown an exemplary exploded perspective view of a hydraulics assembly 220. The hydraulics assembly 220 includes a base portion 230 having a pump (not shown) and hydraulic reservoir adapted to receive hydraulic fluid therein (not shown). An air inlet 240 is coupled to the base portion and contains an actuating means 250 thereon. An air source (not shown) is connected to the air inlet 240. The air source may be what as termed as "shop air", which typically denotes a readily available air supply in mechanic shops and the like. It is appreciated that the air source may comprise any other air supply having sufficient pressure.

In certain embodiments, the actuating means 250 may comprise a switch or valve. A hydraulic delivery mechanism 260 is coupled to the base portion 230 and is adapted to actuate the pump to move hydraulic fluid. A hydraulic removal mechanism 270 is also provided on the base 230 and adapted to allow return flow of hydraulic fluid into the reservoir of the base 230.

Still referring to FIG. 5, coupled to the base 230 and in fluid connection with the hydraulic fluid reservoir is a hydraulic supply line 280. Likewise coupled is a hydraulic return line 290. Both the hydraulic supply line 280 and the hydraulic return line 290 are coupled at opposing ends to a flow control 300. A master hydraulic line 310 is coupled to the flow control 300, which communicates with the hydraulic supply line 280 and the hydraulic return line 290. The flow control 300 may have a valve or the like to directs hydraulic fluid either from the supply line 280 to the master hydraulic line 310, or from the master hydraulic line 310 to the return line 290.

A flow divider 320 is provided coupled to the frame 20 (FIG. 3). The flow divider 320 is connected to at least two flow supply lines 330 and to the master hydraulic line 310. The flow divider 320 functions to divide hydraulic flow from the master hydraulic line 310 to the flow supply lines 330, and from the flow supply lines 330 to the master hydraulic line 310. The flow supply lines 330 are fluidly coupled to respective cylinders 110 at hydraulic fluid ports 340.

The air inlet 240 is connected to an airflow divider 350, which divides airflow between respective airlines 360. The airlines are fluidly coupled to a respective cylinder at an airport 370. Air may travel from the air inlet through the airflow divider to the cylinder, and may return from the cylinder to the air inlet, where it is dissipated through the actuating means 250. Various fittings and the like may be used to couple respective devices and are not limited to what is shown in FIG. 5, depending on the requirements of the system.

Figure 6:
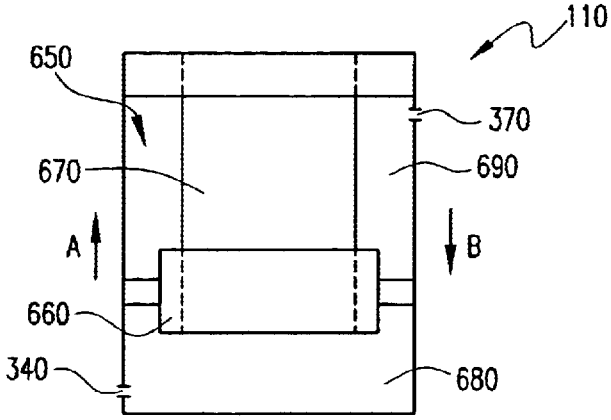
FIG. 6 is an exemplary side perspective view of a cylinder for the dual assist hydropneumatic jack of FIG. 1.

Referring now to FIG. 6, a side view of an exemplary cylinder 110 is shown. The cylinder 110 has an annular chamber 650 for housing a piston 660 coupled to a shaft 670. Hydraulic fluid may be fed into the hydraulic fluid portion 680 of the cylinder 110 via the hydraulic fluid port 340 for forcing the piston 650 and shaft 670 upwards in the direction indicated by reference A due to the pressure exerted on the piston 660 by the hydraulic fluid. The piston 660 and shaft 670 are lowered in the direction indicated by reference B when air is introduced into the air portion 690 of the cylinder 110 and removal of the hydraulic fluid. The weight of the load also assists in the lowering of the piston 660 and shaft 670. A seal 700 is provided along the perimeter of the piston 660 and positioned between the piston 660 and the cylinder 110. The seal 700 prevents fluid communication between the hydraulic fluid portion 680 and the air portion 690 of the cylinder 110.

Figure 7A:
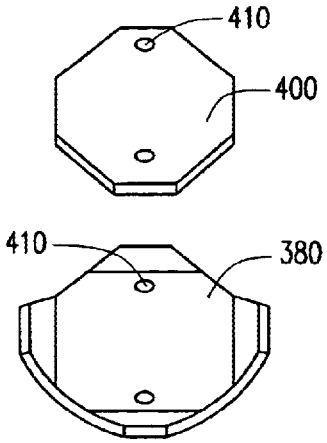
FIGS. 7A–7C are exemplary perspective side views of the lift pads and spacers for the dual assist hydropneumatic jack of FIG. 1.

Referring now to FIG. 7A, there is shown a lift pad 380, which is adapted to secure to an adapter 412*a* (FIG. 7B) to fit on one of the plurality of cylinders 110. Although it is appreciated that the fitting of the lift pad 380 on the respective cylinder 110 can be accomplished in a variety of ways, it is preferred that the lift pad 380 does not move when fitted to the cylinder 110, thereby minimizing frictional forces when the jack 10 is supporting a load. Although not required, an additional buffer pad 400 may be provided on the lift pad 380 to buffer loads that will be supported thereon. The buffer pad 400 maybe composed of a non-metallic material to prevent frictional wear between the lift pad 380 and the buffer pad 400. The lift pad 380 may secure to the buffer pad 400 via fasteners and the like. Thus, corresponding orifices 410 are provided in this embodiment adapted to receive a fastener and fixedly secure the lift pad 380 to the buffer pad 400.

Figure 7C:
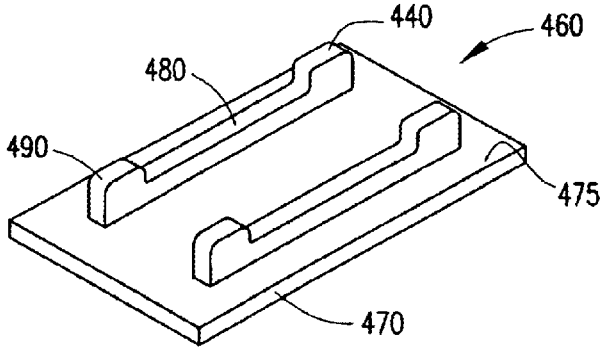
Figure 7B:
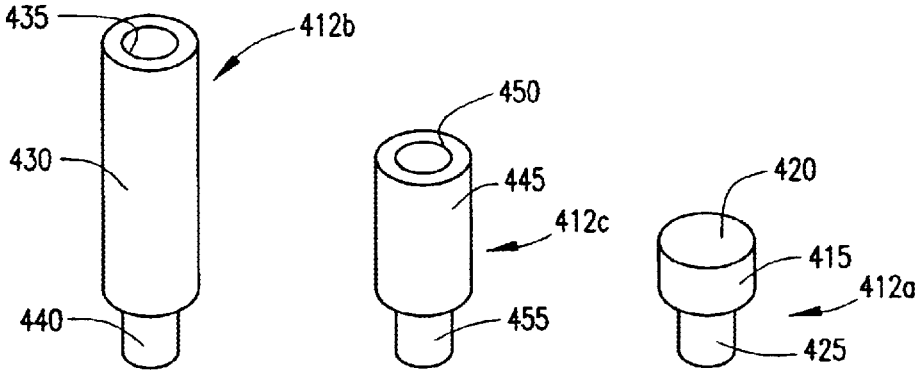

Referring now to FIG. 7B, various embodiments of adapters 412*a*, 412*b*, 412*c*, are shown in exemplary perspective view. Adapter 412*a* is shown in a first configuration, and has an upper portion 415 having a surface 420, and a lower portion 425. Lower portion 425 has a smaller diameter than upper portion 415. Lower portion 425 is adapted to couple with a cylinder 110 (FIG. 3). The surface 420 of the adapter 412*a* is adapted to secure to the lift pad 380 (FIG. 7A).

Adapter 412*b* like wise has an upper portion 430 having an annular orifice 435, and a lower portion 440. The lower portion 440 has a smaller diameter than the upper portion 430. The lower portion 440 is adapted to couple with a cylinder 110 (FIG. 3). The annular orifice 435 may be designed to correspond to lower portion 425 of adapter 412*a*. Adapter 412*b* may be used to extend the distance between a cylinder 110 (FIG. 3) and the lift pad 380 (FIG. 7A), such that loads of varying heights may be more easily supported without requiring additional actuation of the jack 10.

Adapter 412*c* has a similar configuration to adapter 412*b*, except the length of the adapter 412*c* is different from that of adapter 412*b*. Specifically, adapter 412*c* has an upper portion 445 having an annular orifice 450, and a lower portion 455. The lower portion 455 has a different diameter than that of the upper portion 445. The lower portion 455 may be adapted fit on the cylinder 110 and, to adjust the distance between the load that the lift pad, on adapter 412*b*. Likewise, adapter 412*b* may secure onto adapter 412*c*. Through the interchangeability of the adapters 412*b*, 412*c*, various lengths are afforded to the jack 10 to accommodate loads of various heights.

Referring now to FIG. 7C, an alternate embodiment of a lift pad 460 is shown. The lift pad 460 includes a lift base 470 having a top surface 475, and at least one guide 480 coupled thereto. The lift pad 460 may couple to adapter 412*a* (FIG. 7B), which accordingly couples to a cylinder 110. The guide 480 assists in the alignment of a load received thereon, and has raised portions 490 at respective ends of the guide 480. The raised portions 490 serve to prevent movement of a load off of the guide 480. The length of the guide 480 may be adjusted, as well as the raised portions 490, depending on the type of load supported thereon.

In operation, the jack 10 is first positioned via the wheel assembly 180 under a load, such as a motor vehicle. If adapters are required, appropriate adapters and lift pads may be attached to the cylinders 110 prior to positioning the jack 10. The width of the jack 10 under the load may also be adjusted via movement of the axle assembly 170 through the slide channels 160 of the frame 20.

The cylinders 110 are then adjusted to the appropriate width of the load. The hydraulics assembly 220 is then actuated via the hydraulic delivery mechanism 260, and the piston/shaft arrangement in the cylinder raises the lift pad until it contacts the load. Upon contact with the load, the lift pads maybe adjusted to ensure centering of the load on the jack 10. The hydraulic delivery mechanism 260 may again be actuated to force hydraulic fluid into the flow divider and into a respective cylinder, accordingly raising the load a predetermined amount. The lifting of the load serves to lock the wheel assembly and fix the jack 10 in place. To lower the load, the actuating means 250 is engaged to supply air into a top portion of the cylinder 110. The hydraulic removal mechanism 270 is also actuated to allow removal of the hydraulic fluid from the cylinder 110 through the flow divider and back to the reservoir. The weight of the load, coupled with the introduction of air in to the cylinder, lowers the load until disengagement from the jack 10. Wheels of the wheel assembly engage the ground after removal of the load and allow the jack 10 to be removed or repositioned.

Figure 8:
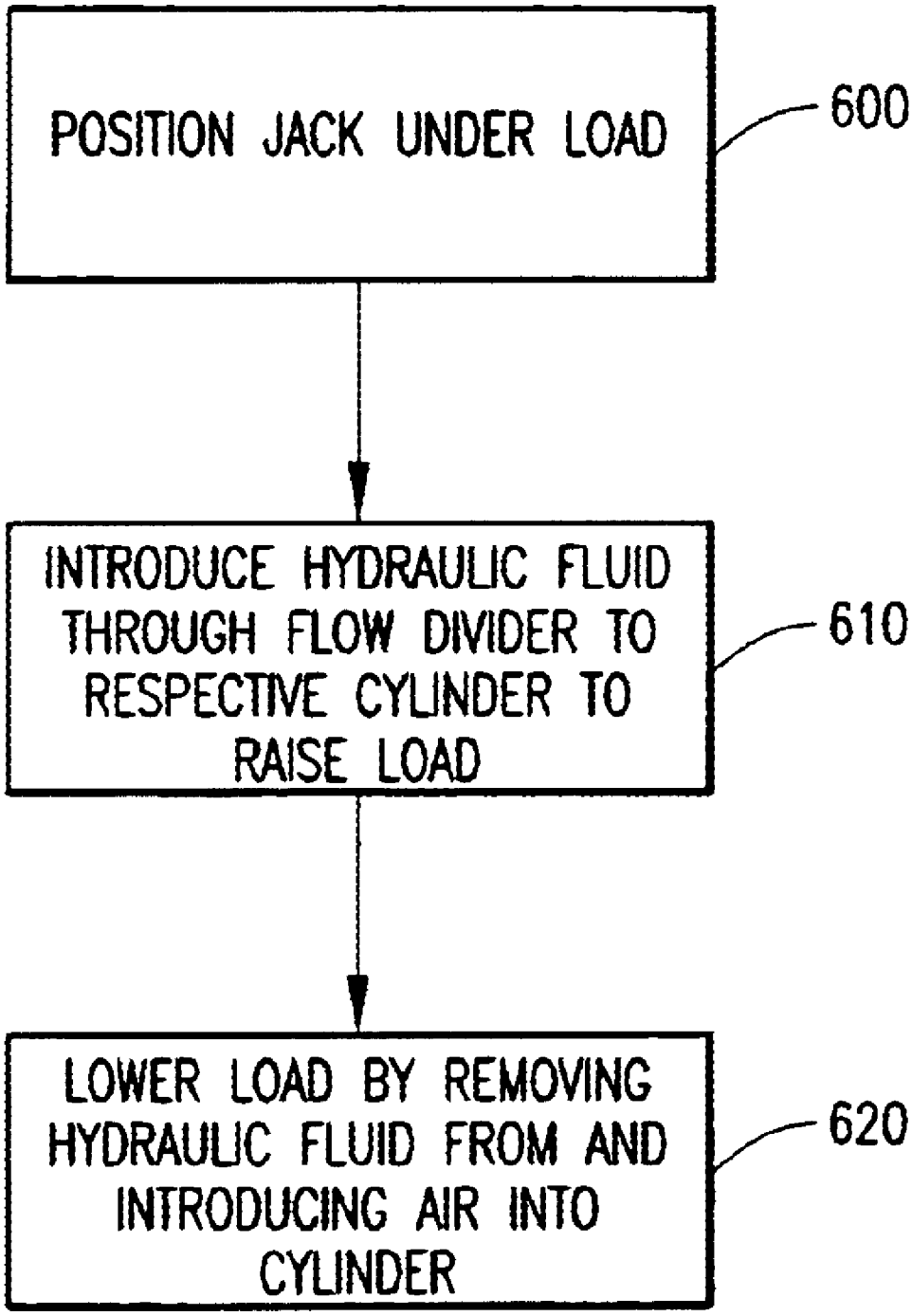
FIG. 8 is an exemplary schematic flow chart of a method according to the principles of the present invention.

Referring now to FIG. 8, an exemplary schematic flow chart for a method according to the principles of the present invention is shown. First, the jack is positioned under a load, shown by box 600. Second, the jack is raised by introduction of hydraulic fluid through the flow divider and into a respective cylinder, exemplified by box 610. Next, the jack is lowered by removal of the hydraulic fluid from the cylinder through the flow divider, introduction of air into the cylinder, and weight of the load, shown in box 620.

It is to be understood that in certain embodiments, two cylinders are preferred to lift a load for balance and stability, although only one cylinder or more than two cylinders maybe used. It is further to be understood that the present invention offers several advantages over prior jack systems, including but not limited to: a decrease in the amount of equipment such as additional pumps and the associated fluid lines for raising and lowering the cylinders; a reduction in the amount of space required by the jack; and an efficient and quick means for lowering the jack using air and the weight of a load applied to the jack.

The previous description is of a preferred embodiment for implementing the invention, and the scope of the invention should not necessarily be limited by this description. The scope of the present invention is instead defined by the following claims.

What is claimed is:

1. A dual-assist hydropneumatic jack, comprising:

a frame having an upper portion, a lower portion, and a central portion, said central portion defining a chamber therein;

a plurality of cylinders slidably coupled to said frame;

a plurality of wheel assemblies coupled to respective ends of said frame, said plurality of wheel assemblies being adapted to support the jack during loading and unloading, said plurality of wheel assemblies having a locking mechanism which prevents movement of said plurality of wheel assemblies when the jack bears a predetermined load;

a hydraulic assembly for providing hydraulic fluid to and receiving hydraulic fluid from said plurality of cylinders;

a flow divider coupled to said frame and positioned between said hydraulic assembly and said plurality of chambers for dividing hydraulic fluid between said plurality of cylinders; and wherein each of said plurality of cylinders include means for raising and lowering in response to hydraulic fluid being introduced therein and evacuated therefrom, and means for lowering in response to air being introduced therein.

2. The dual-assist hydropneumatic jack according to claim 1, wherein said hydraulic assembly comprises:

a base portion containing a hydraulic reservoir, said hydraulic reservoir containing hydraulic fluid therein and having a hydraulic pump;

an air inlet coupled to said base portion, said air inlet having an actuating means thereon;

a hydraulic delivery mechanism coupled to said base portion;

a hydraulic removal mechanism coupled to said base portion;

a hydraulic supply line coupled to said hydraulic reservoir;

a hydraulic return line coupled to said hydraulic reservoir;

a flow control coupled to said hydraulic supply line and said hydraulic return line, said flow control adapted to direct hydraulic fluid to and from said plurality of cylinders;

said flow divider being coupled to and positioned in said chamber of said frame, said flow divider having a fluid connection to said flow control, said flow divider being adapted to divide hydraulic fluid between said plurality of cylinders when hydraulic fluid is supplied thereto, and to receive hydraulic fluid from said plurality of cylinders when hydraulic fluid is evacuated therefrom; and an air outlet coupled to said air inlet at a first end and to an airflow divider at a second end, said airflow divider being adapted to divide air between said plurality of cylinders when air is supplied thereto, and to receive air from said plurality of cylinders when air is evacuated therefrom.

3. The dual-assist hydropneumatic jack according to claim 2, further comprising:

a master hydraulic line coupled to said flow control adapted to deliver and receive hydraulic fluid therethrough.

4. The dual-assist hydropneumatic jack according to claim 3, wherein said flow divider has a fluid connection to said master hydraulic line, said flow divider is adapted to divide hydraulic fluid between said plurality of cylinders when hydraulic fluid is supplied thereto, and said flow divider is adapted to receive hydraulic fluid from said plurality of cylinders when hydraulic fluid is evacuated therefrom.

5. The dual-assist hydropneumatic jack according to claim 1, further comprising:

a plurality of slide channels formed on said lower portion of said frame.

6. The dual-assist hydropneumatic jack according to claim 5, further comprising:

an axle assembly slidably coupled to said lower portion of said frame; and wherein at least one of said plurality of wheel assemblies is coupled to respective ends of said axle assembly.

7. The dual-assist hydropneumatic jack according to claim 5, further comprising:

a plurality of end caps coupled to said frame at opposing ends of said plurality of slide bars; and a plurality of stops perpendicularly coupled to said frame and located within said chamber.

8. The dual-assist hydropneumatic jack according to claim 1, further comprising:

a plurality of slide bars formed on said upper portion of said frame.

9. The dual-assist hydropneumatic jack according to claim 8, where at least one of said plurality of said cylinders is coupled to said plurality of slide channels via a guide assembly.

10. The dual-assist hydropneumatic jack according to claim 9, wherein said guide assembly is adapted to slidably move on said plurality of slide channels.

11. The dual-assist hydropneumatic jack according to claim 1, a lift pad coupled to at least one of said plurality of cylinders.

12. The dual-assist hydropneumatic jack according to claim 11, further comprising a buffer pad coupled to said lift pad.

13. The dual-assist hydropneumatic jack according to claim 1, wherein said cylinder is adapted to receive an adapter thereon.

14. The dual-assist hydropneumatic jack according to claim 1, further comprising:

an adapter holder coupled to said lower portion of said frame, said adapter holder having adapter portions for coupling adapters thereto.

15. The dual-assist hydropneumatic jack according to claim 1, said means for raising said plurality of cylinders comprises at least one of said plurality of cylinders having a piston and a shaft therein, said at least one of said plurality of cylinders having a hydraulic fluid portion and an air portion, said at least one of said plurality of cylinders having a seal therein for preventing communication between said hydraulic fluid portion and said air portion, wherein said plurality of cylinders raise when hydraulic fluid is introduced into said hydraulic portion.

16. The dual-assist hydropneumatic jack according to claim 1, said means for lowering said plurality of cylinders comprises at least one of said plurality of cylinders having a piston and a shaft therein, said at least one of said plurality of cylinders having a hydraulic fluid portion and an air portion, said at least one of said plurality of cylinders having a seal therein for preventing communication between said hydraulic fluid portion and said air portion, wherein said plurality of cylinders raise when hydraulic fluid is introduced into said hydraulic portion, wherein said plurality of cylinders lower when hydraulic fluid is evacuated from said hydraulic portion and air is introduced in said air portion.

17. The dual-assist hydropneumatic jack according to claim 16, wherein said at least one of said plurality of cylinders has a hydraulic fluid port in said hydraulic fluid portion and an air port in said air portion.

18. The dual-assist hydropneumatic jack according to claim 1, further comprising:

a hydraulic assembly orifice centrally located on said central portion, said hydraulic assembly orifice being adapted to receive fluid lines therethrough.

19. The dual-assist hydropneumatic jack according to claim 1, wherein said frame is substantially rectangular.

20. A method for raising and lowering loads, comprising:

providing a dual-assist hydropneumatic jack having a plurality of cylinders having a fluid portion and an air portion;

locating said dual-assist hydropneumatic jack under a load;

raising said jack by providing hydraulic fluid from a hydraulic assembly through a flow divider to a respective fluid portion in a respective one of said plurality of cylinders; and lowering said jack by providing air to a respective air portion in said respective one of said plurality of cylinders and by removing hydraulic fluid from said respective one of said plurality of cylinders through said flow divider.

21. A dual-assist hydropneumatic jack, comprising:

a lifting assembly; and at least one lifting cylinder connected to actuate the lifting assembly, the lifting cylinder having a fluid portion and an air portion, the lifting cylinder raising the lifting assembly in response to hydraulic fluid provision to the fluid portion and lowering the lifting assembly in response to removal of hydraulic fluid from the fluid portion and provision of air to the air portion.

22. The jack of claim 21 further comprising a hydraulic assembly for providing hydraulic fluid to and removing hydraulic fluid from the fluid portion of the lifting cylinder.

23. The jack of claim 22 wherein the hydraulic assembly comprises a hydraulic reservoir, a hydraulic pump and a hydraulic port in the lifting cylinder associated with the fluid portion.

24. The jack of claim 21 further comprising an air assembly for providing air to the air portion of the lifting cylinder.

25. The jack of claim 24 wherein the air assembly comprises an air port in the lifting cylinder associated with the air portion.

26. A method for raising and lowering a load using a dual-assist hydropneumatic jack having a cylinder with a fluid portion and an air portion;

providing hydraulic fluid from a hydraulic assembly to said fluid portion of said cylinder to lift the load; and providing air to said air portion of said cylinder while removing hydraulic fluid from said fluid portion to lower the load.

* * * * *